United States Patent [19]

James et al.

[11] Patent Number: 4,911,345

[45] Date of Patent: Mar. 27, 1990

[54] GUN CADDY

[75] Inventors: Hugh W. James; Jay P. James, both of Wilmington, Del.

[73] Assignee: Remington Arms Company, Wilmington, Del.

[21] Appl. No.: 402,985

[22] Filed: Sep. 1, 1989

Related U.S. Application Data

[63] Continuation of Ser. No. 134,030, Dec. 17, 1987, abandoned.

[51] Int. Cl.[4] ..... F41C 33/02

[52] U.S. Cl. ..... 224/149; 224/253; 224/913

[58] Field of Search ..... 224/149, 224, 150, 226, 224/257, 243, 254, 193, 911, 913

[56] References Cited

U.S. PATENT DOCUMENTS

| | | | |
|---|---|---|---|
| 1,530,342 | 3/1925 | Barber | 224/250 |
| 2,588,467 | 3/1952 | Barney | 224/913 |
| 3,127,075 | 3/1964 | Yavello | 224/913 |
| 3,422,497 | 1/1969 | Lyons | 224/253 |
| 3,700,147 | 10/1972 | Vaughn | 224/149 |
| 4,165,826 | 8/1979 | Chica | 224/911 |
| 4,544,098 | 10/1985 | Tabler | 224/253 |

*Primary Examiner*—Linda J. Sholl
*Attorney, Agent, or Firm*—Alan N. McCartney

[57] ABSTRACT

A gun caddy comprising a belt and a pocket depending from the belt to receive the butt of a rifle or shotgun.

8 Claims, 1 Drawing Sheet

FIG. 1
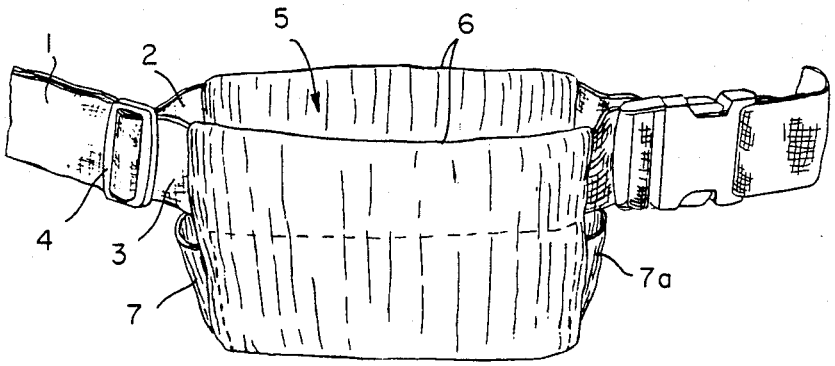
FIG. 3
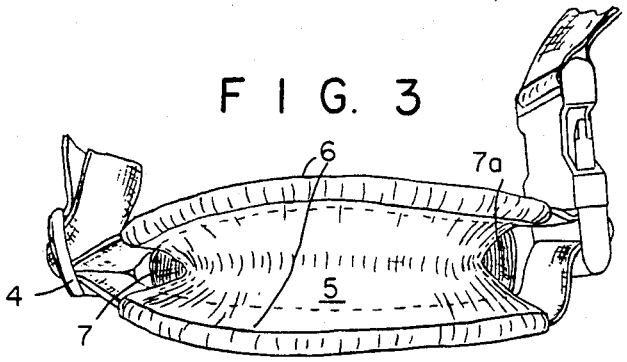
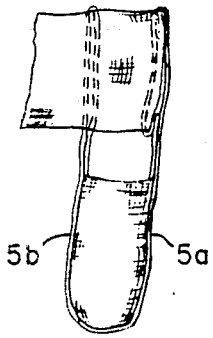
FIG. 2

GUN CADDY

This is a continuation of copending application Ser. No. 134,030, filed on Dec. 17,1987, now abandoned.

BACKGROUND OF THE INVENTION

Hunters and trap shooters alike have long been faced with the problem of carrying a firearm in the field. Slings and straps previously available have proven too cumbersome for carrying rifles and shotguns, requiring, as they do, a relatively long time to bring a gun from the carrying position to a ready position. At the same time, carrying or holding a firearm for extended distances is tiring.

SUMMARY OF THE INVENTION

The present invention provides a gun caddy which permits easy carrying of a rifle or shotgun while retaining its accessibility.

Specifically, the instant invention provides a gun caddy comprising a belt having a width of about from ¾ to 3 inches, the belt being formed to provide an interior base and an exterior loop, the exterior loop being about from one to three inches from the base, and a pocket depending from the interior base and the exterior loop, the pocket being about from one to five inches deep and about from three to eight inches wide.

BRIEF DESCRIPTION OF THE FIGURES

FIG. 1 is a front perspective view of a gun caddy of the present invention.

FIG. 2 is a side view of a gun caddy of the present invention.

FIG. 3 is a top view of a gun caddy of the present invention.

DETAILED DESCRIPTION OF THE INVENTION

The present invention can be best understood by reference to the drawings, in which FIG. 1 is a front perspective view of a gun caddy of the invention. There, belt 1 has an interior base portion 2 and exterior loop 3. The belt is generally about from ¾ to 3 inches wide, an preferably about two inches wide. The exterior loop can be formed with fixed rivets or preferably through the use of adjustable cleat 4. For overall stability of the caddy, the spacing between the edge of the pocket and the cleats or clasp that define the loop should be less than about ½ inch on either side. The belt is adjusted to provide a spacing of about from one to three inches between the base portion and the exterior loop, and preferably about from 1½ to 2 inches. This spacing permits the easy insertion of the butt of the firearm. The use of an adjustable cleat, as shown, permits the installation of the caddy on the user's right or left side, as desired. Typically the belt will be provided with a positive clasp.

The pocket 5, which has a generally U-shaped configuration, depends from the exterior loop and the interior base portion of the belt through loops 6 sewn in the pocket. The pocket can be about from one to eight inches deep, and preferably about from four to six inches deep. Those pockets having a greater depth provide increased stability for the butt of the gun, and preferably have side walls 7 and **7*a*** extending for a distance of at least about one inch from the bottom of the pocket. Those pockets having side walls or a shallower depth prevent the butt of the rifle or shotgun from slipping through the sides of the pocket while it is being carried. The pocket is generally about from four to six inches wide, and is preferably prepared from a woven or knitted elastic fabric. It has been found particularly beneficial to form the pocket from fabric that is elastic in substantially only the vertical direction as the caddy is worn. A particularly satisfactory fabric is one having an elasticity of about from 75% 100% in the warp direction and less than about 20% in the weft direction.

The gun caddy of the invention is further illustrated in FIG. 2, which is a side view of the caddy. In that Figure, front panel **5*a* of the pocket is shown to be continuous with back panel 5*b*, and are joined by side walls 7**. The side walls, when used, should extend at least about one inch from the bottom of the pocket, and provide additional protection, particularly in deeper pockets, against the butt of the rifle slipping out through the sides.

FIG. 3 is a top view of the caddy, showing the spacing between the interior base 2 of the belt and the exterior loop 3.

We claim:

1. A gun caddy capable of holding the butt end of a rifle or shotgun comprising a belt having a width of about from ¾ to 3 inches, the belt being formed to provide an interior base and an exterior loop, the exterior loop being about from one to three inches from the base, and a generally U-shaped pocket having an internal and an external continuous component, the components respectively depending from the interior base and the exterior loop, the pocket being about from one to five inches deep and about from three to eight inches wide, whereby the user can place the butt end in said pocket to carry the gun while retaining the gun's accessibility.

2. A gun caddy of claim 1 wherein the pocket is formed from elastic fabric.

3. A gun caddy of claim 2 wherein the elastic fabric has an elasticity of about from 75 to 100% in the warp direction and less than about 20% in the weft direction.

4. A gun caddy of claim 3 wherein weft direction of the fabric is oriented in the vertical axis of the pocket as worn.

5. A gun caddy of claim 2 wherein the pocket is about from four to six inches deep.

6. A gun caddy of claim 5 further comprising side walls for the pocket extending at least about one inch from the bottom of the pocket.

7. A gun caddy of claim 1 wherein the belt is about two inches wide.

8. A gun caddy of claim 1 wherein the exterior loop is about from 1½ to 2 inches from the base.

* * * * *